US006357592B1

(12) United States Patent
Coia

(10) Patent No.: US 6,357,592 B1
(45) **Date of Patent: *Mar. 19, 2002**

(54) ORGANIZER FOR BANK CHECKS AND STATEMENTS

(76) Inventor: Gerald D. Coia, 92 Mason St., Palmer, MA (US) 01069

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/374,659

(22) Filed: Aug. 16, 1999

Related U.S. Application Data

(60) Provisional application No. 60/099,447, filed on Sep. 8, 1998.

(51) Int. Cl.[7] ..... B65D 73/00

(52) U.S. Cl. ..... 206/472; 206/232; 206/815; 220/524

(58) Field of Search ..... 206/472, 473, 206/387.13, 232, 815, 215, 450, 478, 479, 39; 220/524, 522, 521, 523; 281/31; D6/631, 634; D19/26, 27

(56) References Cited

U.S. PATENT DOCUMENTS

| | | | | | |
|---|---|---|---|---|---|
| 1,445,593 | A | * | 2/1923 | Iscowitz | 220/524 |
| 1,933,894 | A | * | 11/1933 | Cllink | 220/524 |
| 4,002,355 | A | * | 1/1977 | Sendor | 206/472 |
| 4,314,635 | A | * | 2/1982 | Fraser et al. | 206/232 |
| 4,501,361 | A | * | 2/1985 | Rose, Jr. | 206/493 |
| D280,951 | S | * | 10/1985 | Holland | D3/631 |
| 4,635,797 | A | * | 1/1987 | Bankier | 206/472 |
| 4,717,021 | A | * | 1/1988 | Ditzig | 206/472 |
| 4,722,435 | A | * | 2/1988 | Mareels et al. | 206/1.5 |
| 4,765,462 | A | * | 8/1988 | Rose, Jr. | 206/232 |
| 4,869,364 | A | * | 9/1989 | Bray | 206/232 |
| 4,936,462 | A | * | 6/1990 | Yuen | 206/542 |
| 4,977,483 | A | * | 12/1990 | Perretta | 206/472 |
| 5,011,018 | A | * | 4/1991 | Keffeler | 206/532 |
| 5,016,752 | A | * | 5/1991 | Haugen, Jr. | 206/473 |
| D321,788 | S | * | 11/1991 | Chen | D6/631 |
| D324,337 | S | * | 3/1992 | Brady | D9/425 |
| 5,191,972 | A | * | 3/1993 | Heizer et al. | 206/472 |
| 5,566,980 | A | * | 10/1996 | Fizer | 281/31 |
| D381,703 | S | * | 7/1997 | Wiles et al. | D21/57 |
| 5,671,846 | A | * | 9/1997 | Frank | 206/541 |
| D398,527 | S | * | 9/1998 | Maceachern et al. | D9/432 |
| 5,848,700 | A | * | 12/1998 | Horn | 206/570 |
| 5,915,548 | A | * | 6/1999 | Sasaki | 206/307.1 |
| D420,586 | S | * | 2/2000 | MacEachern et al. | D9/432 |

OTHER PUBLICATIONS

Intuit Inc., "Multi–Purpose Storage Boxes", 1998, http://www.intuitmarketplace.co BOX 02.

Intuit Inc., "Multi–Purpose Storage Boxes", 1998, http://www.intuitmarketplace.com/supplies/product.asp, BOX 02.

onlineofficesupplies.com, "Filing and Record Storage", Check File, Fiberboard.

Intuit Inc., "Check Storage Boxes", 1998, http://www.intuitmarketplace.co BOX 01.

Intuit Inc., "Check Storage Boxes", 1998, http://www.intuitmarketplace.com/supplies/product.asp.

* cited by examiner

*Primary Examiner*—Shian Luong
(74) *Attorney, Agent, or Firm*—Cantor Colburn LLP

(57) ABSTRACT

An organizer to receive bank statements and bank checks is disclosed. A bottom is provided and includes a plurality of pockets adapted to receive bank checks. A top portion includes a pocket to receive bank statements. The top portion fits over the bottom portion in a closed position. The pockets have a removable cover to retain the checks and allow the user to view the checks.

20 Claims, 6 Drawing Sheets

ORGANIZER FOR BANK CHECKS AND STATEMENTS

CROSS REFERENCE TO OTHER APPLICATIONS

This application claims priority to Provisional Application No. 60/099,447 filed on Sep. 8, 1998 by the same inventor, which is incorporated herein by reference.

BACKGROUND OF THE INVENTION

1. Field of the Invention

This invention relates generally to organizers for paper materials. More specifically, this invention relates to a new and improved organizer for bank notes and statements for personal and commercial use.

2. Prior Art

It will be appreciated that most households and businesses in modern society receive numerous bank statements each month, not only detailing various banking transactions, but usually enclosing the cancelled bank checks. Quite frequently bank statements are several pages long and the checks are enclosed within the statements, making filing of such materials cumbersome and difficult to organize. Previous attempts at creating a filing system have been employed over the years, however, such filing systems do not take into account the unique way banking papers are presented to the customer, i.e. in statement form with cancelled checks. Thus, there is a need in the industry for an organizer which is adapted to receive bank statements and checks which can be easily accessed and easily filed.

SUMMARY OF THE INVENTION

The above discussed and other drawbacks and deficiencies of the prior art are overcome or alleviated by the organizer of the present invention. In accordance with the present invention, an organizer having a top portion and a bottom portion to receive bank statements and bank checks is disclosed. The bottom portion includes a plurality of pockets adapted to receive bank checks. The top portion includes a pocket to receive bank statements. The top portion fits over the bottom portion in a closed position. In a preferred embodiment, each of the pockets has a retention portion partially disposed over the pocket to retain the bank notes and statements in place. In another embodiment, a cover is removably attached to cover the pocket and retain the checks therein.

BRIEF DESCRIPTION OF THE DRAWINGS

Referring now to the various drawings wherein like elements are numbered alike in the several FIGURES.

DETAILED DESCRIPTION OF THE PREFERRED EMBODIMENT

Figure 1:
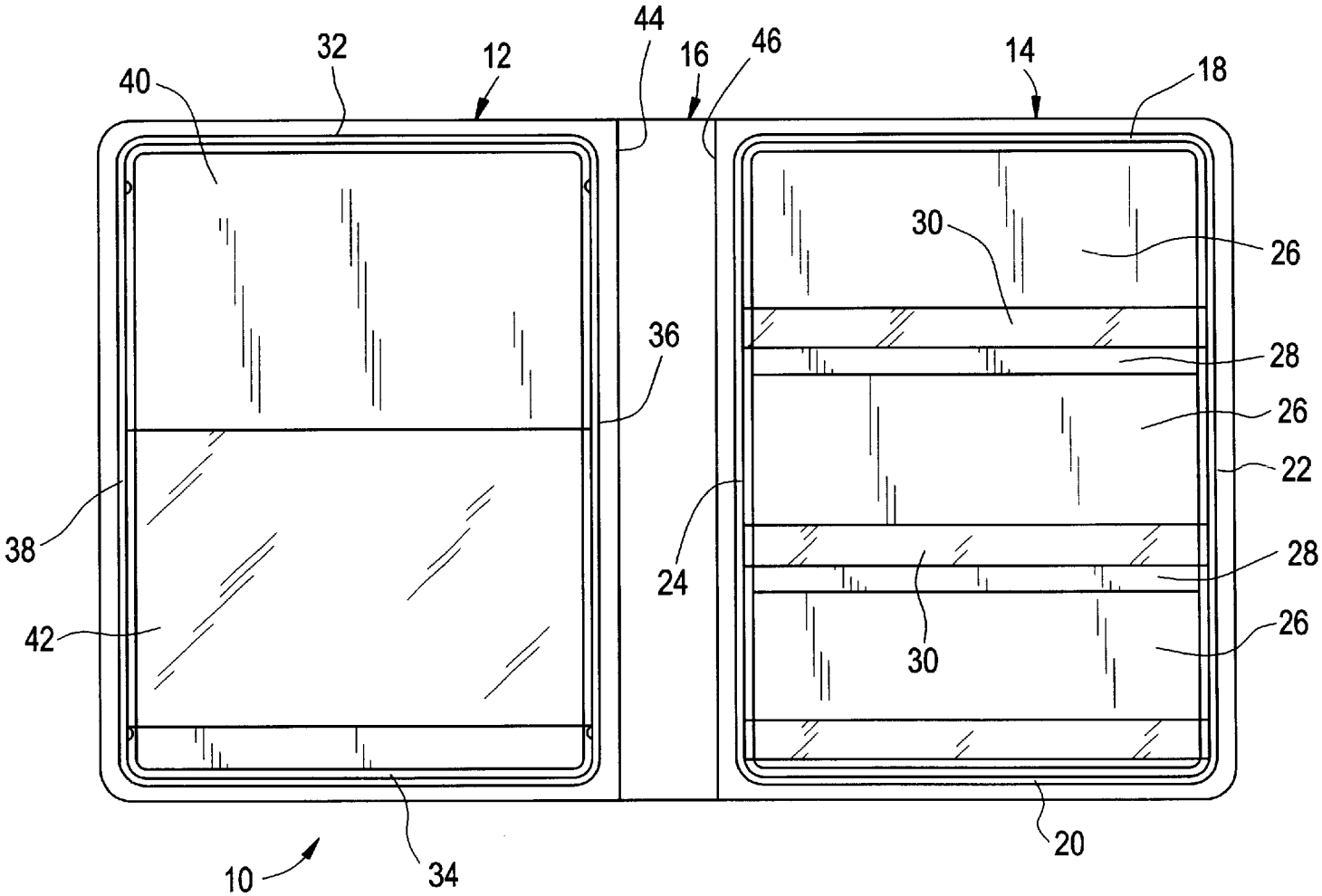
FIG. 1 is a top view of the organizer in accordance with the present invention.

Referring now to FIG. 1, an organizer in accordance with the present invention is generally shown at 10. Organizer 10 includes a top portion 12, a bottom portion 14 and a middle portion 16 (or spine) disposed there between. Bottom portion 14 includes a plurality of walls 18, 20, 22 and 24, extending upward therefrom. Bottom portion 14 has an inner surface 15 and an outer surface 17. A plurality of pockets 26 (recessed portions) are formed by walls 18, 20, 22 and 24, and divider walls 28. Each pocket 26 is sufficiently deep to hold several hundred checks. A resilient band 30, preferably of a plastic or elastomer, is partially disposed over each pocket 26 to retain checks in respective pockets 26.

Top portion 12 includes walls 32, 34, 36 and 38 which form pocket 40 to receive bank statements. Top portion 12 includes an inner surface 11 and an outer surface 13. Walls 32, 34, 36, and 38 extend upward from inner surface 11. A second resilient band 42, made of an elastomer, plastic or other suitable material, is partially disposed over pocket 40 to retain bank statements within pocket 40 of top portion 12.

Figure 3:
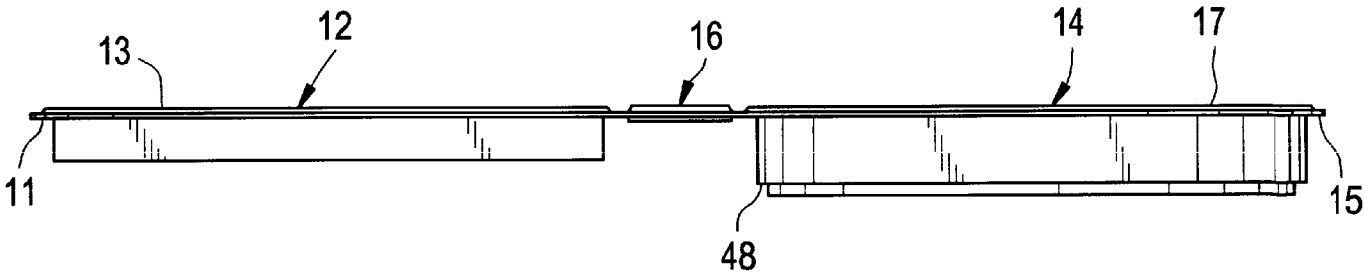
FIG. 3 is a front view of the organizer in accordance with the present invention.
Figure 2:
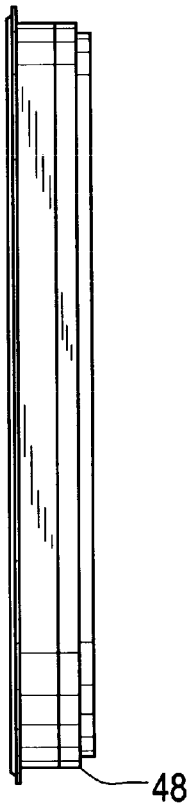
FIG. 2 is a left side view of the organizer in accordance with the present invention.
Figure 5:
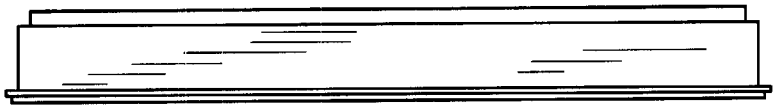
FIG. 5 is a right side view of the organizer in accordance with the present invention.
Figure 4:
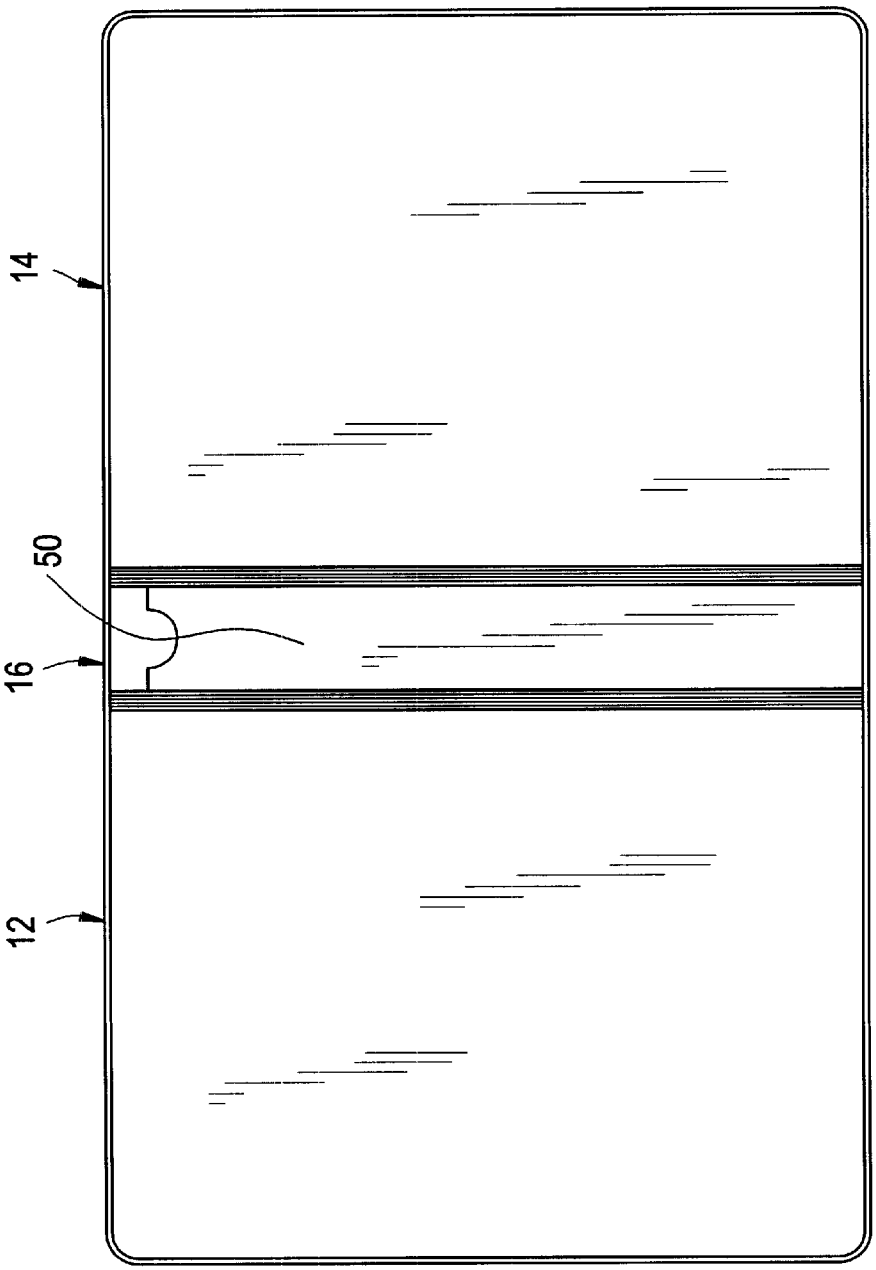
FIG. 4 is a back view of the organizer in accordance with the present invention.

Referring now to FIGS. 1, 2 and 3, top portion 12 is pivotally attached to middle portion or spline 16 along crease 44. Bottom portion 14 is pivotally connected to spline 16 along crease 46. Thus, top portion 12 may be folded on to bottom portion 14 to form a rectangular box shape in a closed portion. Bottom portion 14 includes a recessed surface 48 so that top portion 12 may rest flush against bottom portion 14 when organizer 10 is in a closed position. Inner surface 11 of top portion 12 and inner surface 15 of bottom portion 14 face each other in the closed position. In a preferred embodiment, spline 16 includes a slot 50 made of a clear plastic to receive a label or indicia, indicating information concerning the checks retained in organizer 10.

It will be appreciated by those of ordinary skill in the art based upon reading this disclosure that top portion 12, spline 16 and bottom portion 14 may be made from conventional notebook materials, such as with a vinyl covered substrate. Walls 18, 20, 22 and 24, and divider walls 28 which form pockets 26 may be made of plastic and may be molded as a unit with a bottom wall 52. The entire molded assembly may be affixed as a single unit to bottom portion 14. Similarly, walls 32, 34, 36 and 38 may be made of plastic and may be molded as a unit with a bottom wall 54 with the entire assembly being affixed to top portion 12.

Thus, in use, a user receiving bank statements places statements in pocket 40 and places checks in respective pockets 26. Organizer 10 is then closed and may be filed and/or stacked for access. Pockets 26 may be dimensioned for standard personal bank checks and may also be dimensioned for commercial bank checks.

Figure 6:
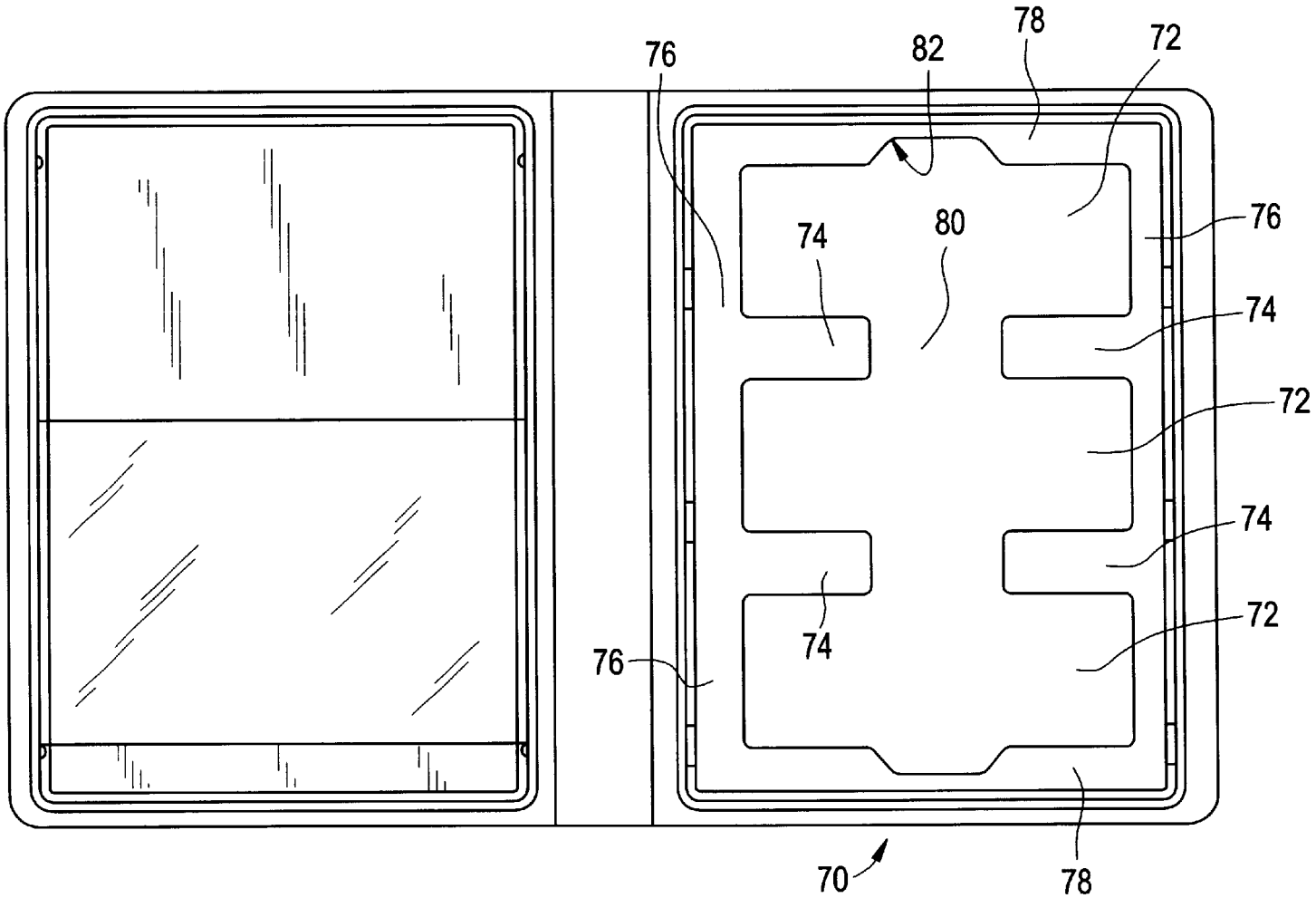
FIG. 6 is a top view of another embodiment of the organizer.
Figure 7:
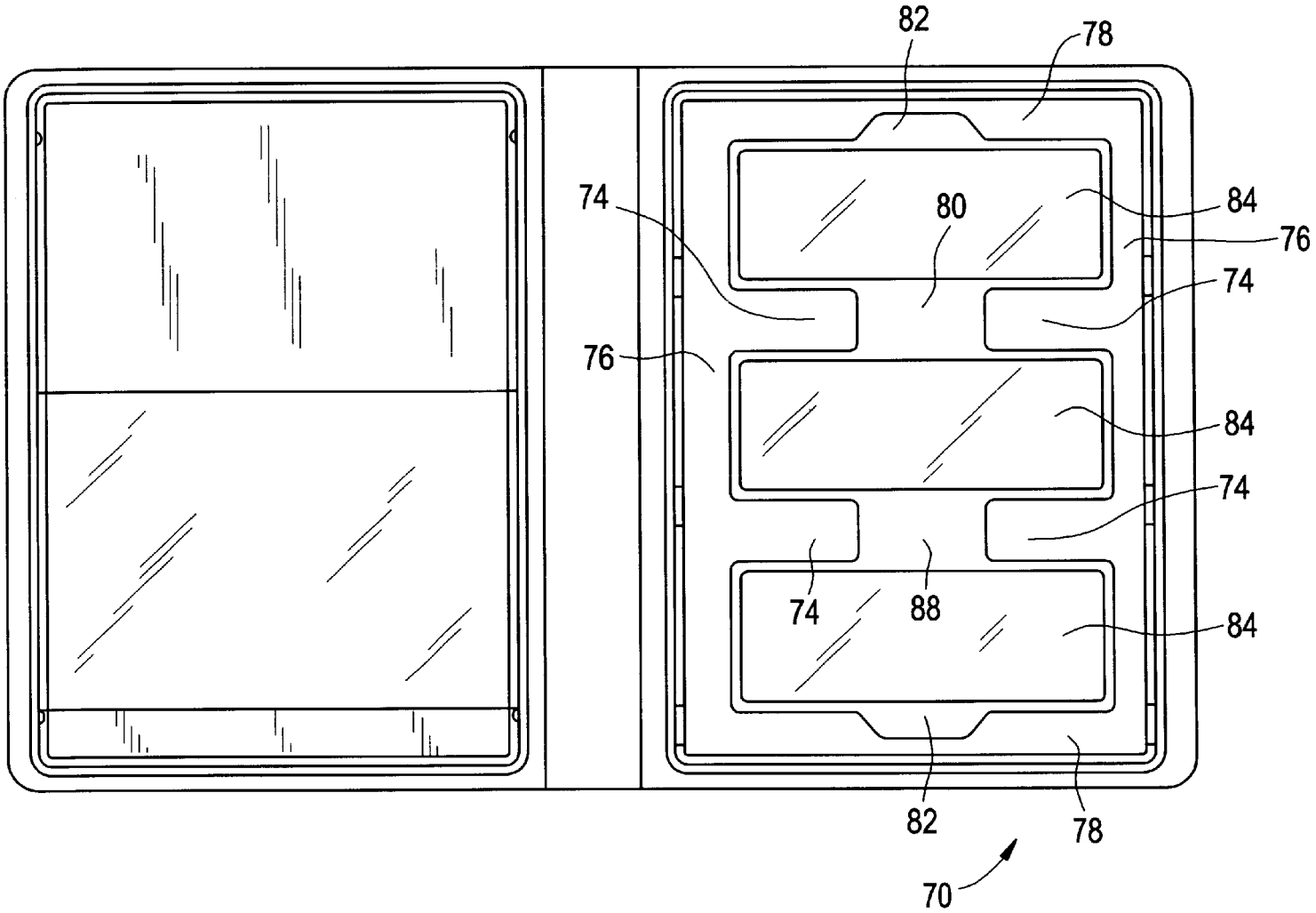
FIG. 7 is a top view of the organizer of FIG. 6 with a plurality of pocket covers.

Now turning to FIGS. 6 and 7, another embodiment of an organizer is generally illustrated at 70. Organizer 70 includes a plurality of check pockets 72 which receive checks to be stored. Check pockets 72 are separated by divider walls 74, and walls 76 and side walls 78. Divider walls 74 include a gap 80. Side walls 78 include a recess portion 82. Gap 80 and recess portion 82 allow the user's fingers to remove the checks. It will be appreciated that divider walls 74, and walls 76, and side walls 78 may be formed as a unit, i.e. molded, preferably of polyvinyl chloride (PVC). Pocket covers 84 are removably attached to cover pockets 72. Preferably, pocket covers 84 frictionally engage walls 74, 76 and 78.

Figure 8:
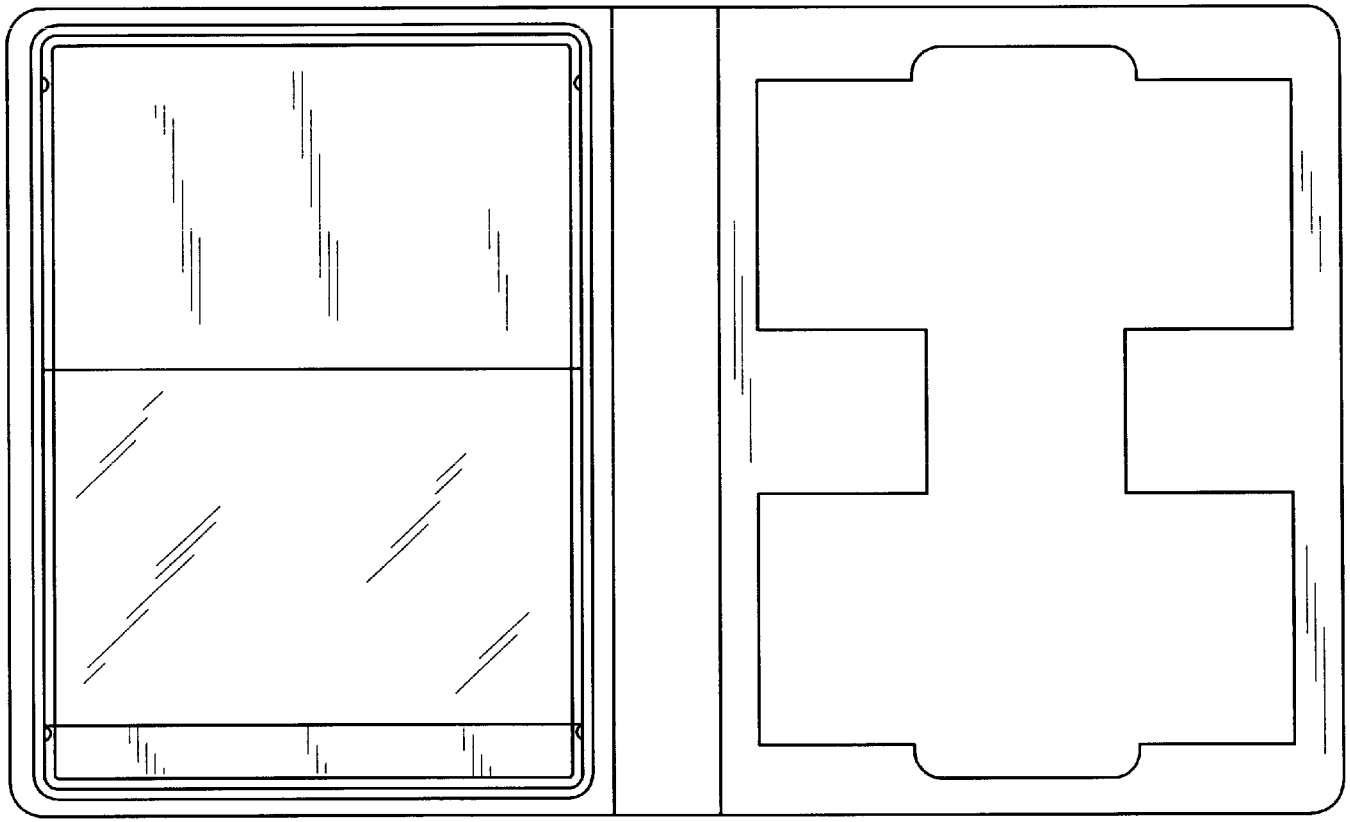
FIG. 8 is a top view of an alternate embodiment.

Pocket covers 84 may be made of a clear plastic or other suitable material and may include a pocket for receiving a label or indicia for the checks to be stored. Alternatively, as shown in FIG. 8, the device may have any number of pockets, such as two pockets.

While the preferred embodiments have been shown and described, various modifications may be thereto without departing from the spirit and scope of the invention. Accordingly, it is to be understood the present invention has been described by way of illustration and not by limitation.

What is claimed is:

1. An organizer, comprising:

a first portion having a cavity;

a second portion hingedly coupled to said first portion, said second portion having a plurality of pockets;

bank statements, contained within said cavity in an unfolded manner, said cavity sized to contain said bank statements;

bank checks, contained within said plurality of pockets in an unfolded manner, said plurality of pockets sized to contain said bank checks;

a plurality of walls, side walls and divider walls extending from said second portion to form said plurality of pockets, said divider walls separating said plurality of pockets and having a gap equal in height to said divider walls, said side walls having a notch equal in height to said side walls, whereby said gap and said notch enable the user to insert multiple fingers into said gap and said notch to remove any number of said bank checks from said pockets;

a plurality of covers, each of said covers being removably attached to cover respective said pockets;

a flange, said flange encompassing the perimeter of respective said covers;

a groove, said groove perpendicularly extending from respective said covers, whereby said groove frictionally engages said plurality of walls, side walls and divider walls thereby enabling respective said covers to be removably attached to cover respective said pockets.

2. An organizer according to claim 1, further comprising:

a spline, said spline hingedly coupling said first portion and said second portion.

3. An organizer according to claim 1, wherein:

said first portion comprises a first side and a second side, and said cavity is formed by a plurality of cavity walls extending from one of said sides.

4. An organizer according to claim 1, further comprising:

a strip partially disposed over said cavity to retain bank statements therein.

5. An organizer according to claim 1, wherein:

said second portion comprises two pockets.

6. An organizer according to claim 1, wherein:

said second portion comprises three pockets.

7. An organizer comprising:

a first portion, said first portion having a front side and a rear side, said rear side having a cavity, said cavity being formed by a plurality of cavity walls extending from said rear side;

a second portion hingedly coupled to said first portion, said second portion having a first side and a second side, said second side having a plurality of pockets;

bank statements, contained within said cavity in an unfolded manner, said cavity sized to contain said bank statements;

bank checks, contained within said plurality of pockets in an unfolded manner, said plurality of pockets sized to contain said bank checks;

a plurality of walls, side walls and divider walls, said divider walls separating said plurality of pockets and having a gap equal in height to said divider walls, said side walls having a notch equal in height to said side walls, whereby said gap and said notch enable the user to insert multiple fingers into said gap and said notch to remove any number of said bank checks from said pockets;

a plurality of covers, each of said covers being removably attached to cover respective said pockets;

a flange, said flange encompassing the perimeter of respective said covers, and a groove, said groove perpendicularly extending from respective said covers, whereby said groove frictionally engages said plurality of walls, side walls and divider walls thereby enabling respective said covers to be removably attached to cover respective said pockets.

8. An organizer according to claim 7, comprising:

a spline, said spline hingedly coupling said first portion and said second portion.

9. An organizer according to claim 7, further comprising:

a strip partially disposed over said cavity to retain said bank statements therein.

10. An organizer according to claim 7, wherein:

said second portion comprises two pockets.

11. An organizer according to claim 7, wherein:

said second portion comprises three pockets.

12. An organizer comprising:

a top cover, said top cover having a front side and a rear side, said rear side having a plurality of cavity walls extending therefrom to form a cavity, a spine coupled to said top cover, a bottom cover, said bottom cover having an inner side and an outer side, said bottom cover being coupled to said spine, said top cover being movable with respect to said bottom cover so that said rear side of said top cover opposes said inner side of said bottom cover when the organizer is in a closed position, said bottom cover having a plurality of recessed portions;

bank statements, contained within said cavity in an unfolded manner, said cavity sized to contain said bank statements;

bank checks, contained within said plurality of recessed portions in an unfolded manner, said plurality of recessed portions sized to contain said bank checks;

a plurality of walls, side walls and divider walls extending from said inner side of said bottom cover to form said plurality of recessed portions, said divider walls separating said plurality of recessed portions and having a gap equal in height to said divider walls, said side walls having a notch equal in height to said side walls, whereby said gap and said notch enable the user to insert multiple fingers into said gap and said notch to remove any number of said bank checks from said recessed portions;

a plurality of covers, each of said covers being removably attached to cover respective said recessed portions, a flange, said flange encompassing the perimeter of respective said covers, and a groove, said groove perpendicularly extending from respective said covers, whereby said groove frictionally engages said plurality of walls, side walls and divider walls thereby enabling respective said covers to be removably attached to cover respective said recessed portions.

13. An organizer according to claim 12, wherein:

said cavity is formed within a molded plastic portion attached to said rear side of said top cover.

14. An organizer according to claim 12, wherein:

said recessed portions are formed within a molded plastic portion attached to said inner side of said bottom cover.

15. An organizer according to claim 12, further comprising:

a strip partially disposed over said cavity to retain the bank statements in said cavity.

16. An organizer according to claim 15, wherein:

said covers are made of clear plastic.

17. An organizer according to claim 12, wherein:

the organizer forms a rectangular shaped box when in a closed position.

18. An organizer according to claim 12, further comprising:

a plurality of recessed wall portions communicating with said recessed portions.

19. An organizer according to claim 12, wherein:

said bottom cover comprises two recessed portions.

20. An organizer according to claim 12, wherein:

said bottom cover comprises three recessed portions.

* * * * *